US007059070B2

(12) United States Patent
Omstead et al.

(10) Patent No.: US 7,059,070 B2
(45) Date of Patent: Jun. 13, 2006

(54) FOOTWEAR CONTAINING IMPROVED AUDIO/VISUAL DISPLAYS

(75) Inventors: Thomas R. Omstead, Fremont, CA (US); Alina Gover, Wilmington, DE (US)

(73) Assignee: Alina Designs, Inc., Wilmington, DE (US)

( * ) Notice: Subject to any disclaimer, the term of this patent is extended or adjusted under 35 U.S.C. 154(b) by 0 days.

(21) Appl. No.: 10/697,151

(22) Filed: Oct. 31, 2003

(65) Prior Publication Data

US 2005/0091884 A1 May 5, 2005

(51) Int. Cl.
*A43B 23/00* (2006.01)

(52) U.S. Cl. ..... 36/137; 36/139; 362/103

(58) Field of Classification Search ..... 36/139, 36/132, 137
See application file for complete search history.

(56) References Cited

U.S. PATENT DOCUMENTS

| | | | | |
|---|---|---|---|---|
| 2,931,893 | A | 4/1960 | Arias et al. | |
| 3,008,038 | A | 11/1961 | Dickens et al. | |
| 3,800,133 | A | 3/1974 | Duval | |
| 3,893,247 | A | 7/1975 | Dana, III | |
| 4,014,115 | A | 3/1977 | Reichert | |
| 4,020,572 | A * | 5/1977 | Chiaramonte, Jr. | 361/137 |
| 4,112,601 | A * | 9/1978 | Chiaramonte, Jr. | 36/137 |
| 4,128,861 | A | 12/1978 | Pelengaris | |
| 4,130,951 | A * | 12/1978 | Powell | 36/137 |
| 4,158,922 | A | 6/1979 | Dana, III | |
| 4,253,253 | A | 3/1981 | Mc Cormick | |
| 4,510,704 | A * | 4/1985 | Johnson | 36/136 |
| 4,848,009 | A | 7/1989 | Rodgers | |
| 5,052,131 | A | 10/1991 | Rondini | |
| 5,118,319 | A | 6/1992 | Smith et al. | |
| 5,303,485 | A | 4/1994 | Goldston et al. | |
| 5,371,662 | A | 12/1994 | Shen-Ko | |
| 5,406,724 | A | 4/1995 | Lin | |
| 5,456,478 | A | 10/1995 | Hsu et al. | |
| 5,477,435 | A | 12/1995 | Rapisarda et al. | |
| 5,500,635 | A * | 3/1996 | Mott | 340/323 R |
| D369,233 | S | 4/1996 | Haber et al. | |
| 5,502,903 | A | 4/1996 | Barker | |
| 5,508,899 | A | 4/1996 | McCormick | |
| 5,546,681 | A * | 8/1996 | Goldston et al. | 36/137 |
| 5,604,999 | A | 2/1997 | Barker | |
| 5,720,121 | A | 2/1998 | Barker | |
| 5,732,486 | A | 3/1998 | Rapisarda | |
| 5,746,499 | A | 5/1998 | Ratcliffe et al. | |
| 5,894,686 | A | 4/1999 | Parker et al. | |
| 5,903,103 | A | 5/1999 | Garner | |
| 5,929,332 | A | 7/1999 | Brown | |

(Continued)

*Primary Examiner*—Ted Kavanaugh
(74) *Attorney, Agent, or Firm*—Fish & Richardson P.C.

(57) ABSTRACT

Illuminated footwear including a translucent sole insert housing LEDs, preferably of different colors which may be combined to produce a wide array of colors is provided. The heel similarly includes a translucent insert and includes an interior mirror material and an illumination source. An on/off switch in the toe of the footwear is connected in a circuit with a replaceable battery, a control processor and the LEDs. The control processor includes logic that may dim, strobe, or shut off all or some of the LEDs. In operation, when the device is activated, the LEDs are illuminated. The light from the individual LEDs is blended and reflected by the interior mirror materials in an outward direction from the shoe. The translucent material in the sole and heel of the shoe allows the blended light to pass through to create a pleasing visual effect.

12 Claims, 7 Drawing Sheets

U.S. PATENT DOCUMENTS 5,930,921 A * 8/1999 Sorofman et al. ..... 36/137
5,932,336 A 8/1999 Allen et al.
6,007,211 A 12/1999 Cheung
6,030,089 A 2/2000 Parker et al.
2002/0048169 A1 4/2002 Dowling et al.
2004/0114353 A1* 6/2004 Romeo ..... 362/103

* cited by examiner

FOOTWEAR CONTAINING IMPROVED AUDIO/VISUAL DISPLAYS

FIELD OF THE INVENTION

This invention relates generally to footwear and more particularly to footwear containing improved audio and/or visual displays capable of producing light, movement or sound.

BACKGROUND OF THE INVENTION

The footwear market has been increasingly expanding and increasingly profitable for manufacturers in the United States and abroad. The various types of footwear and options available in footwear is continually growing to serve an increasingly diverse and demanding consumer market. Today's consumers are presented with a wide variety of footwear from fashion to functional to suit virtually every need or occasion. In the ever growing footwear market, manufacturers, as well as consumers, are continually looking for footwear that differentiates themselves from others and stands out. This was previously accomplished by changing the physical design or appearance of the footwear by altering properties such as the shape, color, size or material of the footwear, for example. However, more recently, footwear manufacturers have begun introducing electronics into their products to achieve this result.

The design of footwear has not changed in basic form over the years. Typical footwear is comprised of essentially two parts: a sole positioned beneath a wearer's foot and an upper connected to the sole that holds it to the wearer's foot. These two components however, may have widely varied forms depending on the particular application of the footwear. For example, soles may be cushioned and supportive for athletic applications such as sneakers; thin and lightweight for recreational applications such as sandals; or rigid with a high heel for formal applications such as men's and women's fashion shoes. Additionally, the uppers may similarly be adapted to the purpose of the footwear. Uppers may consist of sturdy and rugged materials with laces in the case of work boots, or may consist of thin fabric straps as in women's formal shoes, for example. The previous examples merely serve as an introduction as numerous other styles and types of traditional footwear are well known in the art.

Footwear having various types of lighting devices incorporated therein is also known in the art. Lighting devices have been incorporated into a variety of footwear, including dress shoes, athletic shoes, boots, sandals, for example. The inclusion of lighting devices in footwear has been utilized for a number of reasons including permitting the wearer to see or be seen in reduced light situations; to provide special effects during entertainment events; or as an element of fashion on the part of the wearer.

There are several known implementations of footwear lighting devices. One of the most basic implementations involves the use of a light source, such as an incandescent bulb, a neon tube, or a light emitting diode powered by a portable power supply, such as a battery, utilizing a manually operated on-off switch. These elements are connected as an electric circuit and are located in a convenient location in the footwear, such as within the sole, the heel, and/or the tongue structures to provide the desired effect. Examples of these types of devices in the prior art may be found in U.S. Pat. No. 2,931,893 to Arias et al.; U.S. Pat. No. 4,253,253 to McCormick; U.S. Pat. No. 5,303,485 to Goldston et al.; and U.S. Pat. No. 5,732,486 to Rapisarda.

The prior art also discloses numerous devices utilizing externally attached light sources. Examples include U.S. Pat. No. 5,903,103 to Garner; U.S. Pat. No. 6,007,211 to Cheung; U.S. Pat. No. 6,030,089 to Parker et al.; U.S. Pat. No. 5,508,899 to McCormick; U.S. Pat. No. 5,894,686 to Parker et al.; and U.S. Pat. No. 5,604,999 to Barker. A more complex implementation of lighted footwear includes the addition of a switching circuit that switches the light on and off in association with the presence or the absence of the wearer's foot in the shoe, or the contact or impact of the wearer's foot with the ground. Examples of these types of devices may be found in U.S. Pat. No. 3,008,038 to Dickens et al.; U.S. Pat. No. 3,800,133 to Duval; U.S. Pat. No. 4,014,115 to Reichert; U.S. Pat. No. 4,128,861 to Pelengaris; U.S. Pat. No. 4,130,951 to Powell and U.S. Pat. No. 5,052,131 to Rondini.

Additional prior art implementations involve the use of a motion detector that is utilized to detect the angular position of the wearer's foot. The detection of a predetermined angular position of the footwear relative to the plane of the ground causes the light to illuminate. Such a motion detector may involve the use of a "tilt switch," such as a mercury switch, to sense the angular position of the shoe with respect to the gravity gradient to activate the circuit at a particular attitude of the shoe. Examples of footwear containing lighting circuits activated by the angular position of the footwear include those found in U.S. Pat. Nos. 3,893,247 and 4,158,922, both to Dana, III, and U.S. Pat. No. 4,848,009 to Rodgers.

Although prior art footwear that incorporates lighting devices provides additional desirable features over traditional footwear that does not include such devices, a number of shortcomings in the prior art still exist. For example, typical prior art devices incorporate relatively simple lighting sources that are either "on" or "off." Although the lights may flicker or strobe in connection with the wearer's gait or foot angle, for example, they do not typically vary in color, intensity, pattern or direction. Furthermore, typical prior art devices do not allow the user to adjust or manipulate the illumination, which, may result is a less customizable and wearer-centric experience.

An additional limitation of typical illuminated footwear is that the illumination color, pattern, intensity, etc. is not correlated in any meaningful way to the physical or emotional state of the user. A further limitation is that typical prior art devices simply provide for the appearance of light emitting diodes ("LED") in the sole of a shoe. The illumination does not blend colors or illuminate the entire sole giving off a general illumination as opposed to merely a row or rows of LEDs.

A broader limitation of traditional prior art footwear that incorporates electronics is that the footwear does not typically incorporate audio displays either alone or in conjunction with visual displays. Thus, typical prior art footwear may be limited in its ability to produce a more engaging audio/visual experience. An additional limitation in typical prior art systems is the inability of the devices in the footwear to sense and adapt to the environment or the wearer. This inability may result in a less wearer-centric or customized experience for the wearer.

SUMMARY OF THE INVENTION

The present invention overcomes the aforementioned drawbacks in the prior art by providing for improved audio and/or visual displays capable of producing light, movement or sound, or a combination thereof. It is an object of the present invention to provide footwear that may be fully or partially illuminated in a manner that provides for the changing or blending of color, intensity and pattern of the illumination either automatically or through wearer control. An additional object of the present invention is to provide footwear that includes an audio display either alone or in conjunction with a visual display to enhance the experience of the wearer. A further object of the present invention is to provide for footwear that can sense changes in the environment or in the physical or emotional state of the wearer and adjust its audio or visual display in reaction to the changes.

In a preferred embodiment of the present invention, a shoe is presented with a sole and a heel. The sole includes a translucent insert and a U-shaped interior mirror material. Between the mirror material and the exterior of the sole is an illumination source, such as LEDs. The LEDs are preferably different colors and may be combined to produce a wide array of colors. The heel similarly includes a translucent insert and includes an interior mirror material and an illumination source. An on/off switch in the toe of the shoe is connected in a circuit with a replaceable battery, a control processor and the LEDs. The control processor includes logic that may dim, strobe, or shut off all or some of the LEDs. In operation, a wearer activates the device by pressing the on/off switch. When the device is activated, the LEDs are illuminated. The light from the individual LEDs is blended and reflected by the interior mirror materials in an outward direction from the shoe. The translucent material in the sole and heel of the shoe allows the blended light to pass through to create a pleasing visual effect.

In an alternative embodiment, the translucent inserts of the heel and the sole of the shoe include opaque portions. The opaque portions may be various shapes, such as stars, letters or numbers, for example, so that when the shoe is illuminated, the light passing through the translucent inserts but blocked by the opaque portions provides an illuminated image. Alternatively, the translucent insert can be in various shapes with the remainder of the shoe and heel being opaque.

The details of one or more embodiments of the invention are set forth in the accompanying drawings and the description below. Other features, objects, and advantages of the invention will be apparent from the description and drawings, and from the claims.

BRIEF DESCRIPTION OF DRAWINGS

Like reference symbols in the various drawings indicate like elements.

DETAILED DESCRIPTION OF THE INVENTION

Figure 1A:
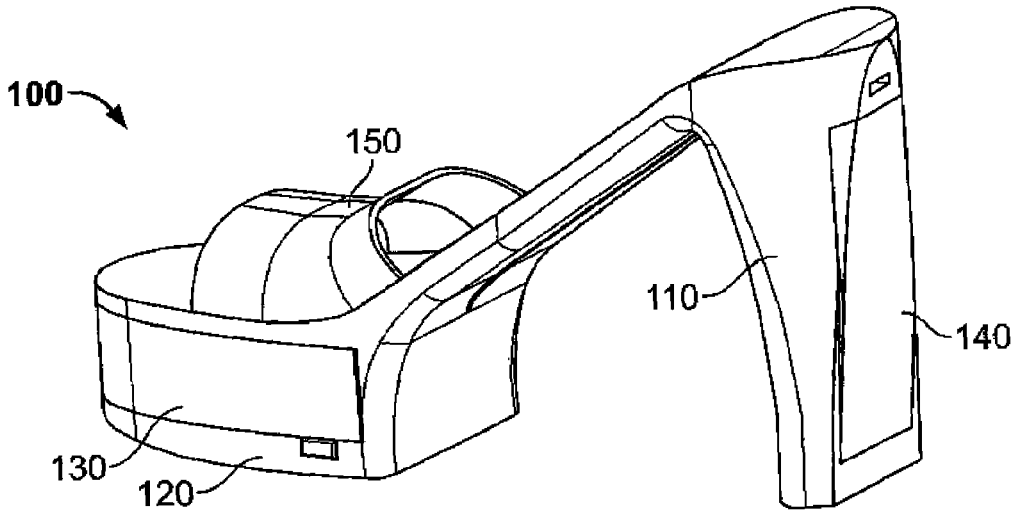
FIG. 1 illustrates a perspective view of an illuminated shoe according to the preferred embodiment of the present invention.
Figure 1B:
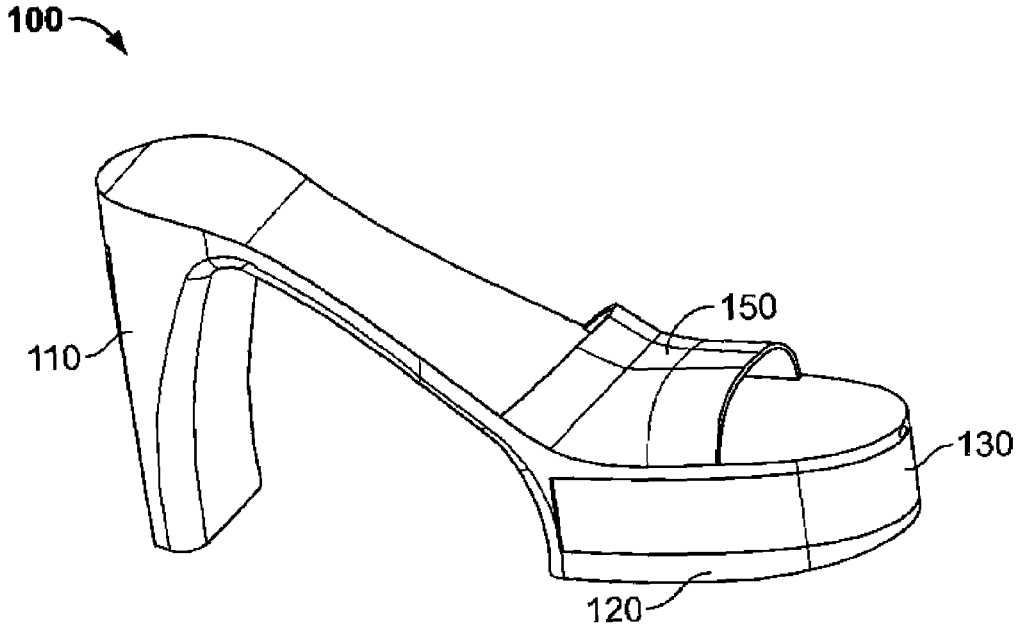

FIG. 1 illustrates a perspective view of an exemplary illuminated shoe 100 according to the preferred embodiment of the present invention. The illuminated shoe 100 includes a heel 110, a sole 120, a translucent sole insert 130, a translucent heel insert 140 and an upper 150.

As illustrated in FIG. 1, the translucent sole insert 130 is U-shaped and inserted into the sole 120. The sole 120 may be made of a variety of common materials used in the shoe industry such as leather, rubber, or a urethane polymer, for example. The translucent sole insert 130 preferably extends from one side of the sole, across the front of the sole and around the other side of the sole 120. The translucent sole insert 130 is preferably comprised of polymer materials well known in the art, such as urethane, that allows light to pass through but does not allow a viewer to see the internal components of the illuminated shoe 100, such as individual LEDs and wiring, from the outside. Thus, the material of the translucent sole 130 is preferably translucent and not transparent, although a transparent sole insert may be used. Alternatively, the entire sole 120 of the illuminated shoe 100 may be comprised of a translucent material allowing for illumination of the entire sole portion of the shoe. As illustrated in FIG. 1, the upper is attached to the top of the sole 120 of the illuminated shoe 100 and is used to hold the illuminated shoe 100 to the foot of a wearer. However, many variations of shoe design are known in the art and may be adapted to the design of the present invention.

Similarly, the translucent heel insert 140 is inserted into the heel 110 of the illuminated shoe 100 as illustrated in FIG. 1. The heel 110 may also be made of a variety of common materials used in the shoe industry such as leather, rubber, or a urethane polymer, for example. The translucent heel insert 140 preferably extends from a portion beneath the top of the heel 110 to a portion above the bottom of the heel 110 and extends the entire width of the heel 110. The translucent heel insert 140 is also comprised of the same polymer material that the translucent sole insert 130 is comprised of and includes the same properties and characteristics. Alternatively, the translucent heel insert 140 may be comprised of a transparent material and may comprise the entire heel 110 allowing for illumination of the entire heel portion of the shoe.

Figure 2A:
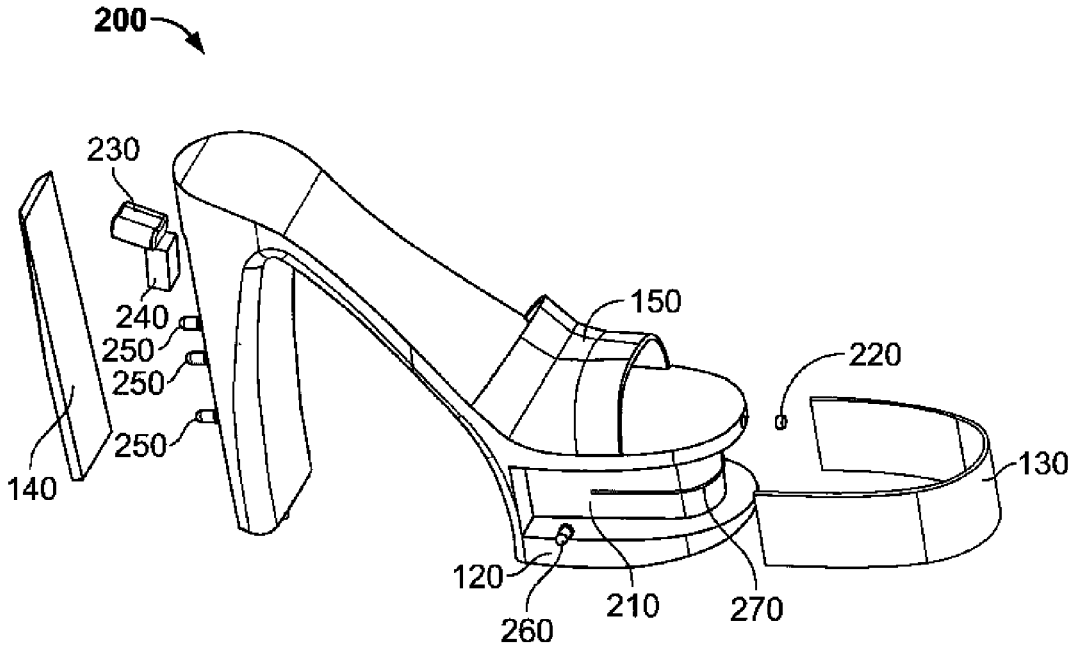
FIG. 2 illustrates an exploded perspective view of an illuminated shoe according to the preferred embodiment of the present invention of FIG. 1.
Figure 2B:
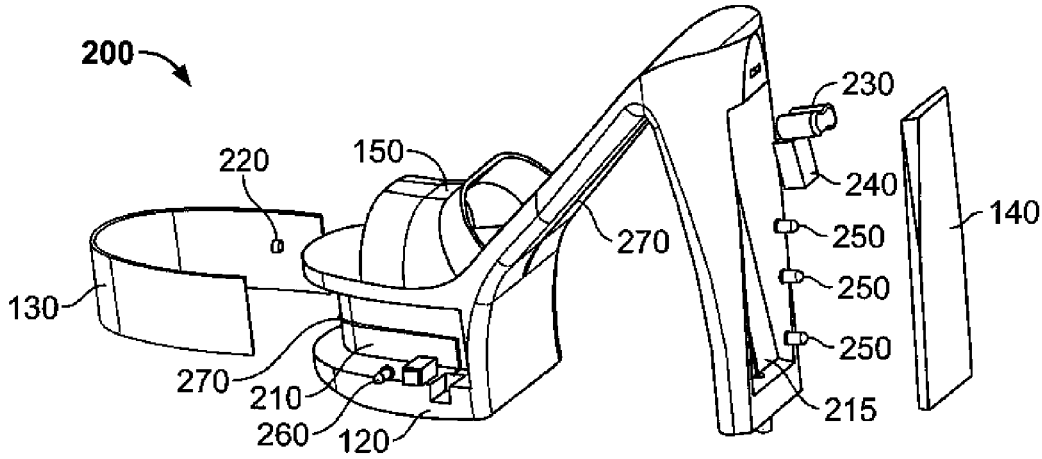

FIG. 2 illustrates an exploded perspective view of an illuminated shoe 200 according to the preferred embodiment of the present invention. The exploded perspective view of the illuminated shoe 200 includes a sole mirror material 210, heel mirror material 215, an on/off switch 220, a battery 230, a control processor 240, heel LEDs 250, sole LEDs 260, connective wiring 270, as well as the heel 110, the sole 120, the translucent sole insert 130, the translucent heel insert 140 and the upper 150 of FIG. 1.

As further illustrated in FIG. 2, the U-shaped translucent sole insert 130 is located as shown in the sole 120 of the illuminated shoe 200. The sole mirror material 210 is also preferably U-shaped and placed behind the translucent sole insert 130 in the interior portion of the sole 120 with the reflective surface of the mirror material facing outward from the interior of the sole 120. Thus, the sole mirror material 210 acts as a backing for the translucent sole insert 130. The sole mirror material 210 is preferably a thin mirrored sheet material such as acrylic. The sole LEDs 260 are preferably located between the reflective surface of the sole mirror material 210 and the translucent sole insert 130 such that the sole LEDs 260 are not visible from the outside of the illuminated shoe 200. The sole 120 of the illuminated shoe 200 may contain any number of LEDs of various size or color. Preferably, the sole LEDs 260 are different colors. At the front of the sole 120 is the on/off switch 220. The on/off switch 220 is preferably a push button but may be a variety of switches such as a toggle switch or a dial, for example.

Turning to the heel 110 of the illuminated shoe 200, the translucent heel insert 140 is further illustrated. As shown in FIG. 2, the battery 230 and control processor 240 are preferably located in the heel 100 of the illuminated shoe 200, but may also be located in the sole 120. As in the sole 120 of the illuminated shoe 200, the heel 110 also includes a heel mirror material 215 located behind the translucent heel insert 140 with its reflective surface facing outward from the interior of the heel 120. The heel LEDs 250 are similarly located between the reflective surface of the heel mirror material 215 and the outer surface of the translucent heel insert 140 such that the heel LEDs 250 are not visible from the outside of the illuminated shoe 200. The heel 140 of the illuminated shoe 200 may also contain any number of LEDs of various size or color. Preferably, the heel LEDs 250 are different colors.

The battery 230, the control processor 240, the sole LEDs 260, the heel LEDs 250 and the on/off switch 220 are connected by connective wiring 270 to form a circuit. In operation, a wearer would press the on/off switch 220 completing the circuit and activating the sole LEDs 260 and the heel LEDs 250. The sole mirror material 210 and heel mirror material aid in reflecting the light from the sole LEDs 260 and the heel LEDs 250 out through the translucent sole insert 130 and translucent heel insert 140 respectively. Thus, the illumination form the illuminated shoe 200 is the result of both direct and reflected light. Furthermore, the control processor 240 preferably contains logic, well known in the art, that alters the visual characteristics of the sole LEDs 260 and the heel LEDs 250 by cyclically illuminating the various sole LEDs 260 and the heel LEDs 250 at varying brightness such that the varying blending of colors produces a continually variable illumination that continuously blends and changes color. Additionally, imperfections such as notches, grooves, holes or bubbles may be introduced into the translucent sole 130 or the translucent heel insert 140. Such imperfections would further refract the exiting light to produce a number of different visual characteristics.

Alternatively, the control processor 240 may provide for other visual characteristics including intermittent illumination, full time mono-color illumination or various combinations thereof, for example. In one embodiment, the on/off switch 220 may be toggle switch, for example, to toggle on different color LEDs or different combinations of LEDs providing a more interactive and personalized experience for the wearer. Furthermore, the on/off switch 220 may be a continuous dial allowing the user to adjust the brightness of the LEDs or the blending of colors of the LEDs for example. In an example of this embodiment, the sole LEDs 260 may include three yellow LEDs and three blue LEDS. When the dial is at one end position only the yellow LEDs are illuminated at full intensity. As the dial is rotated, the blue LEDs become increasingly rotated while the yellow LEDs are decreasingly illuminated. Thus, when the dial reaches the opposite end position, only the blue LEDs are fully illuminated. At any dial position between the end points, the blue and yellow LEDs are illuminated at varying degrees causing a blending of the colors to provide various shades of green (combination of yellow light and blue light) as the overall illumination from the translucent sole insert 130. As can be appreciated from the previous examples, many combinations of switches and color LEDs would be apparent to one of ordinary skill in the art.

In an alternative embodiment, the illuminated shoe may include a sole that runs along the entire bottom of the shoe as found in a sneaker, sandal or other flat bottomed shoe, for example. In this embodiment, the sole and heel are incorporated into the same structure. The translucent sole insert would extend around the entire perimeter of the shoe and function in substantially the same manner described above.

Figure 3A:
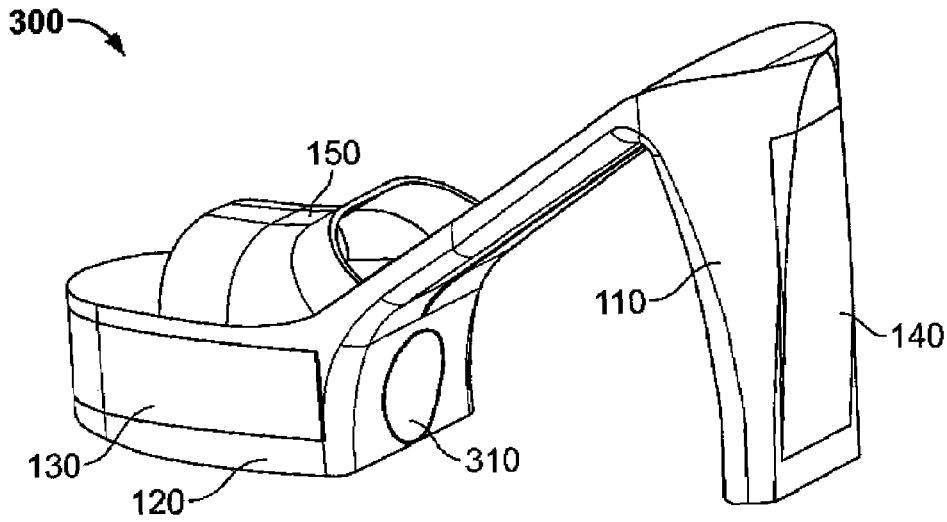
FIG. 3A illustrates a perspective view of an audio/visual shoe according to an alternative embodiment of the present invention.

FIG. 3A illustrates a perspective view of an audio/visual shoe 300 according to an alternative embodiment of the present invention. The audio/visual shoe 300 includes a speaker 310 as well as the heel 110, the sole 120, the translucent sole insert 130, the translucent heel insert 140 and the upper 150 of the illuminated shoe 100 discussed above with respect to FIG. 1. The speaker 310 is preferably mounted in the rear portion of the sole 120 as illustrated in FIG. 3A. However, the speaker may be mounted in a variety of positions or multiple speakers could be used.

Figure 3B:
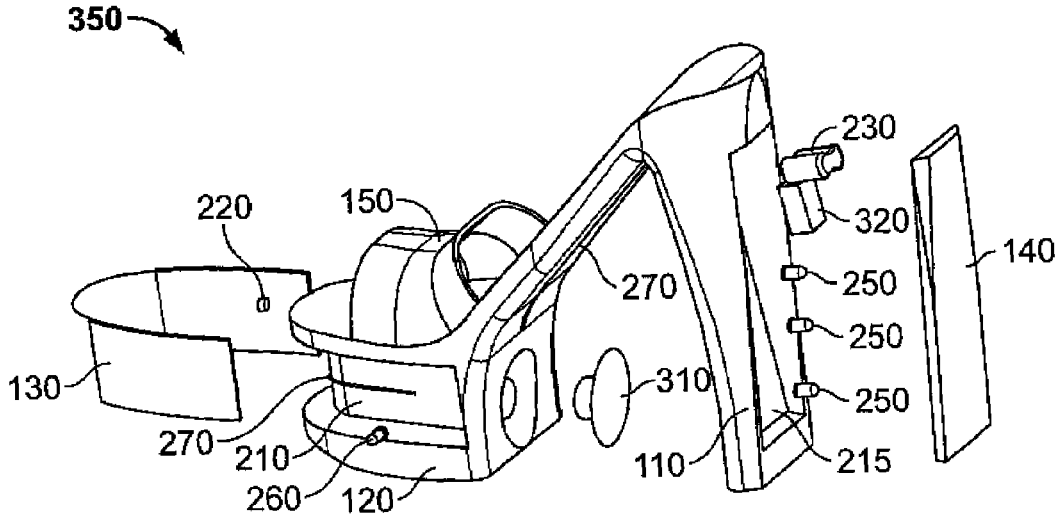
FIG. 3B illustrates an exploded perspective view of an audio/visual shoe according to the alternative embodiment of the present invention of FIG. 3A.

FIG. 3B illustrates an exploded perspective view of an audio/visual shoe 350 according to an alternative embodiment of the present invention. The exploded perspective view of the audio/visual shoe 350 includes a speaker 310 and an audio/visual control processor 320, as well as the heel 110, the sole 120, the translucent sole insert 130, the translucent heel insert 140 and the upper 150, the sole mirror material 210, the heel mirror material 215, the on/off switch 220, the battery 230, the heel LEDs 250, the sole LEDs 260, and the connective wiring 270.

In operation, the audio/visual control processor 320 would preferably contain the logic to cyclically illuminate the various sole LEDs 260 and heel LEDs 250 as discussed above. However, the audio/visual control processor 320 would contain additional audio circuitry either on-board or through additional circuitry in the audio/visual shoe 350, as discussed below, to generate an audio signal. The audio signal generated by the audio/visual control processor 320 would then be displayed in the form of sound audible to the wearer and any surrounding observers through the speaker 310. Preferably, the audio/visual shoe 350 includes a pressure switch (not shown) on either the bottom of the sole, the bottom of the heel, or both, that when contacted, activates the audio circuitry which produces a desired sound effect to be played through the speaker 310. The audio/visual control processor 320 could contain tapping sounds to simulate tap dancing, percussion sounds or any other type of sound the wearer desires to play when the switch is activated. Alternatively, sole switch may play one type of sound and the heel switch may play another sound providing a more varied audio experience to the wearer. In another alternative embodiment, a motion sensor may be used to activate the audio circuitry in conjunction with the motion of a wearer's feet.

Figure 4A:
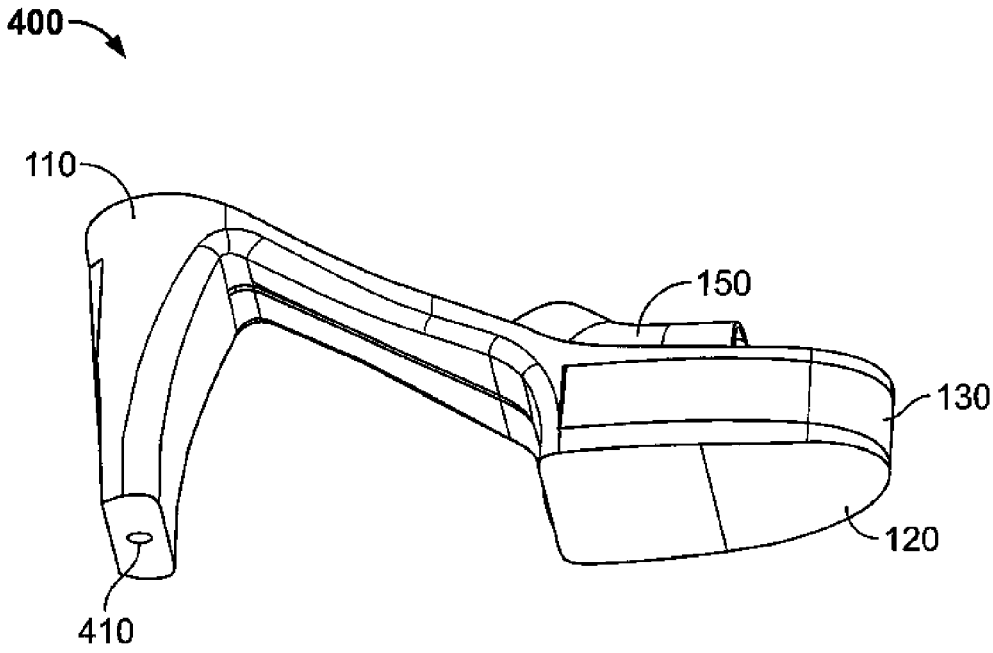
FIG. 4A illustrates a bottom-up perspective cut-away view of an audio/visual shoe according to the alternative embodiment of the present invention of FIGS. 3A and 3B.

FIG. 4A illustrates a bottom-up perspective cut-away view of an audio/visual shoe 400 according to an alternative embodiment of the present invention. FIG. 4A includes a heel activated pressure switch 410 as discussed above with respect to FIG. 3B.

Figure 4B:
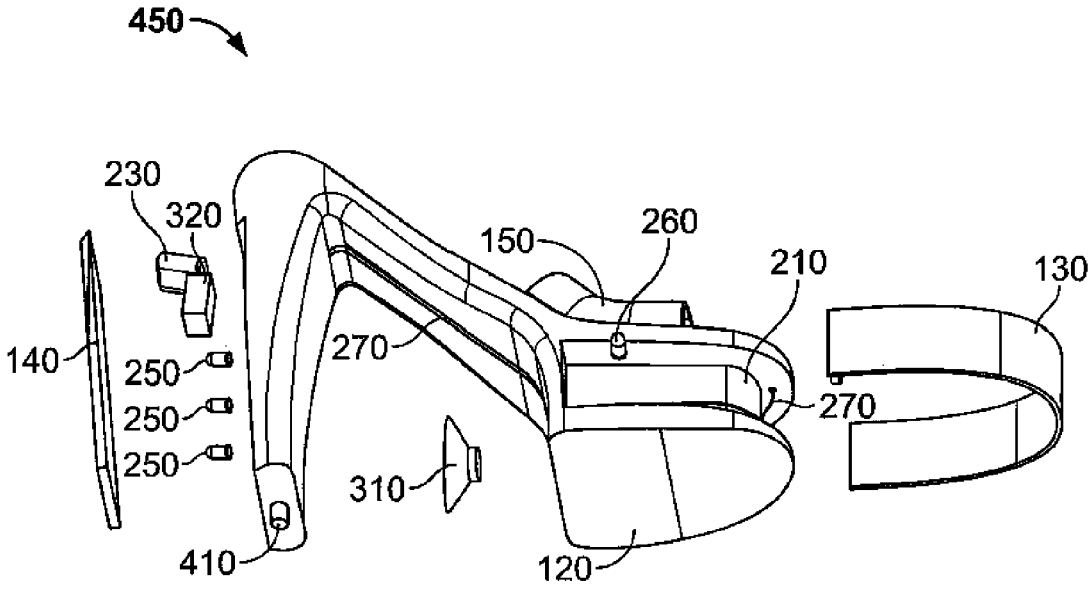
FIG. 4B illustrates an exploded bottom-up perspective cut-away view of an audio/visual shoe according to the alternative embodiment of the present invention of FIGS. 3A, 3B, and 4A.

FIG. 4B illustrates an exploded bottom-up perspective cut-away view of an audio/visual shoe 450 according to an alternative embodiment of the present invention.

Figure 5A:
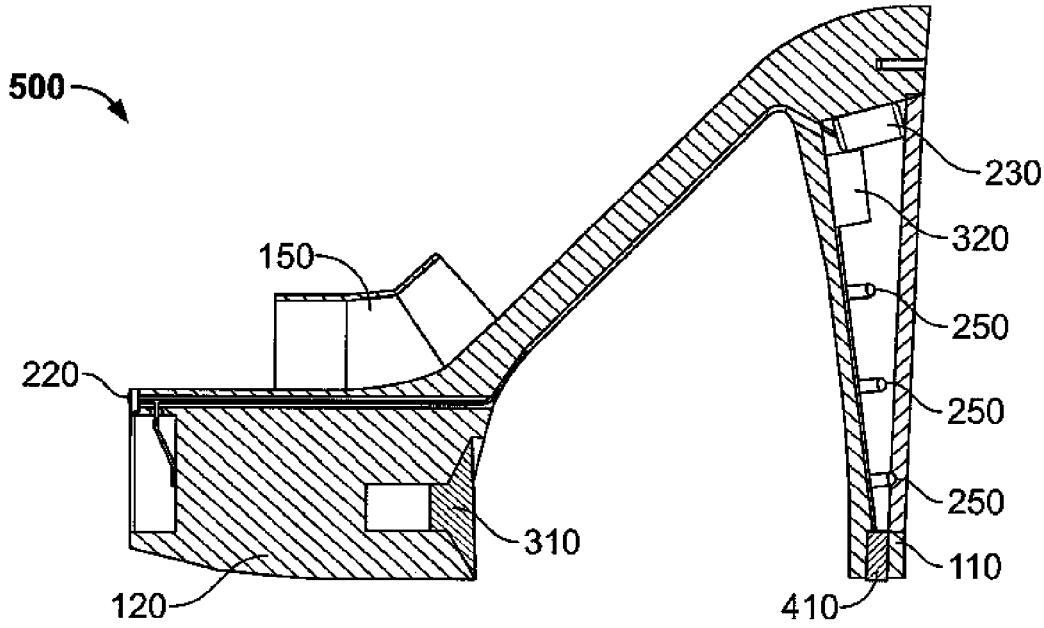
FIG. 5 illustrates a cut-away side view of an audio/visual shoe according to the alternative embodiment of the present invention of FIGS. 3A, 3B, 4A, and 4B.
Figure 5B:
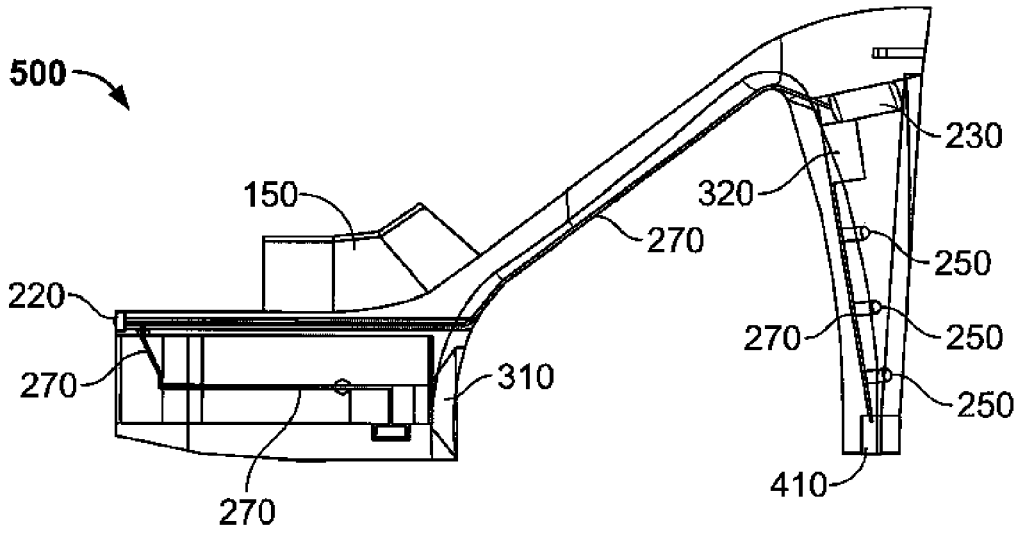

FIG. 5 illustrates a cut-away side view of an audio/visual shoe 500 according to an alternative embodiment of the present invention. From the above description it can be seen that the audio/visual shoe of the present invention is able to overcome the shortcomings of prior art devices by providing footwear audio in conjunction with visual displays. This provides a more engaging audio/visual experience to the wearer.

Figure 6A:
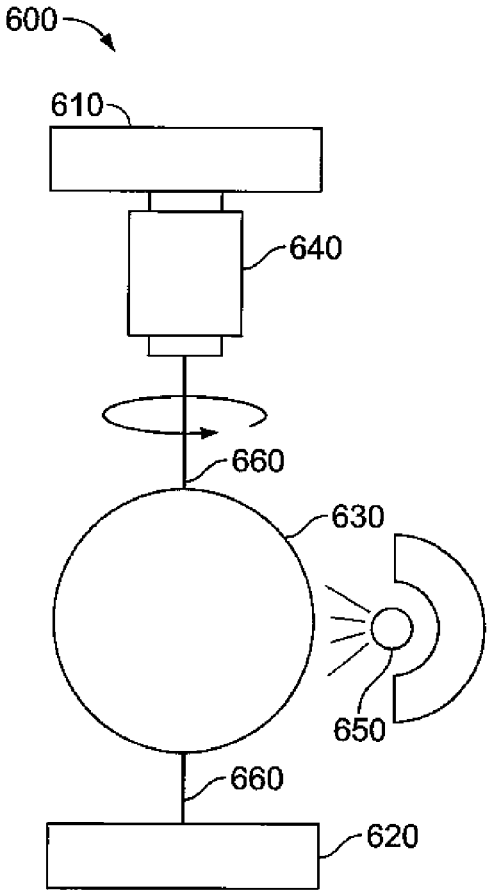
FIG. 6A illustrates a rotational effect device according to an alternative embodiment of the present invention.

FIG. 6A illustrates a rotational effect device 600 according to an alternative embodiment of the present invention. The rotational effect device 600 includes an upper support 610, a lower support 620, a rotating plate 630, a connecting bar 660, and a rotary motor 640. The rotational effect device 600 is inserted into a cavity created in the translucent sole insert 130 or the translucent heel insert 140. The rotational effect device 600 is supported by the upper support 610 attached to the top of the translucent sole insert 130, for example, and the lower support 620 attached to the bottom of the translucent sole insert 130. The cavity would be large enough to allow the rotating plate 630 to rotate freely about the axis of the connecting bar 660. The rotary motor 640 is attached to the upper support 610 at one end and has the connecting bar 660 extending from the opposite end. The rotating plate 630 is attached halfway down the connecting bar 660 as illustrated in FIG. 6A. The rotating plate 630 may be mirrored, translucent or transparent. The end of the connecting bar 660 not attached to the rotary motor 640 is secured in the lower support 620 and allowed to rotate freely. The rotary motor 640 is also connected to circuit including the battery 230, the control processor 240 and the LEDs in the illuminated shoe 200. Alternatively, the rotary motor 640 may be connected to an alternate battery. The rotary plate 630 is positioned in front of a light source 650 which may an LED as described above.

In operation, when the illuminating shoe 200 is activated, the rotary motor 640 rotates the connecting bar 660 causing the rotary plate 630 to rotate. The light source 650 projects light at the rotating rotary plate 630 causing the light exiting the shoe to intermittently display a pattern in the shape of the rotating plate 630 depending on the speed of rotation. Although this embodiment has been described with reference to a top and a bottom, it may be applied in a sideways orientation or at an angle. Additionally, the rotary motor 640 may be removed and the rotary plate 630 may be allowed rotate freely due to movement of the wearer.

Figure 6B:
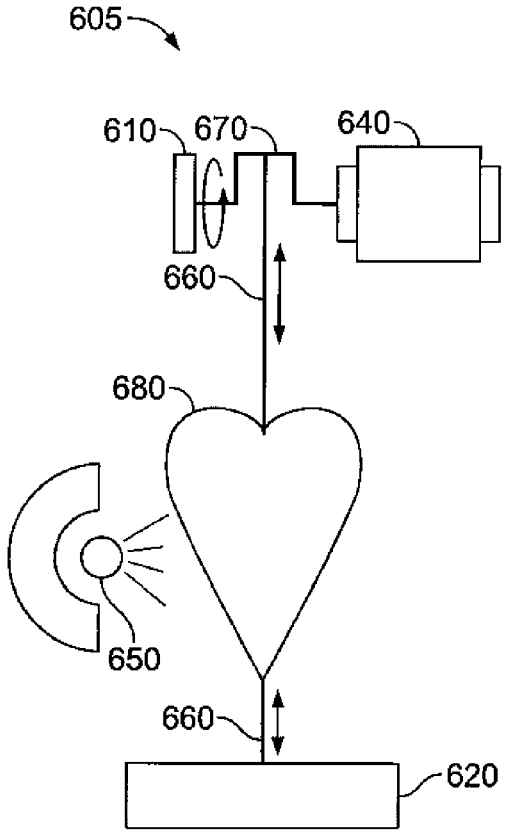
FIG. 6B illustrates a translational effect device according to an alternative embodiment of the present invention.

FIG. 6B illustrates a translational effect device 605 according to an alternative embodiment of the present invention. The translational effect device 605 includes a rotary shaft 670 and a translational plate 680, as well as the upper support 610, the lower support 620, the connecting bar 660, and the rotary motor 640 discussed above with respect to FIG. 6A. The translational effect device 605 is similarly inserted into a cavity created in the translucent sole insert 130 or the translucent heel insert 140. The translational effect device 605 is supported by the upper support 610 attached to the top of the translucent sole insert 130, for example, and the lower support 620 attached to the bottom of the translucent sole insert 130. The cavity would be large enough to allow the translational plate 580 to translate up and down inside the cavity. The rotary motor 640 is attached to the rotary shaft 670 as illustrated in FIG. 6B. The rotary shaft 670 is connected to the connecting bar 660 as illustrated in picture 6B to created a "piston type" effect. The translational plate 680 is attached halfway down the connecting bar 660. The translational plate 680 may be mirrored, translucent or transparent. The end of the connecting bar 660 not attached to the rotary motor 640 is secured in the lower support 620 and allowed to translate up and down freely. The rotary motor 640 is also connected to circuit including the battery 230, the control processor 240 and the LEDs in the illuminated shoe 200. Alternatively, the rotary motor 640 may be connected to an alternate battery. The translational plate 680 is positioned in front of a light source 650 which may an LED as described above.

In operation, when the illuminating shoe 200 is activated, the rotary motor 640 rotates the rotary shaft 670 causing the connecting bar 660 to move in an up and down motion. This up and down motion causes the translational plate 680 to similarly move in an up and down motion. The light source 650 projects light at the translational plate 680 causing the light exiting the shoe to intermittently display a pattern in the shape of the rotating plate 630 depending on the speed of translation. Although this embodiment has been described with reference to a top and a bottom, it may be applied in a sideways orientation or at an angle. Additionally, the embodiments described in FIGS. 6A and 6B could readily be combined to allow for both simultaneous rotational and translational movement of a plate.

From the above description it can be seen that the illuminated footwear of the present invention is able to overcome the shortcomings of prior art devices by providing footwear with variable illumination color, pattern or intensity that can blend colors or illuminate the entire sole giving off a general illumination as opposed to merely a row or rows of LEDs. Furthermore, some embodiments of the present invention allow a wear to manually manipulate the visual characteristics of the illuminated footwear providing an increased level of customization and user interaction not previously available in the prior art.

Figure 7A:
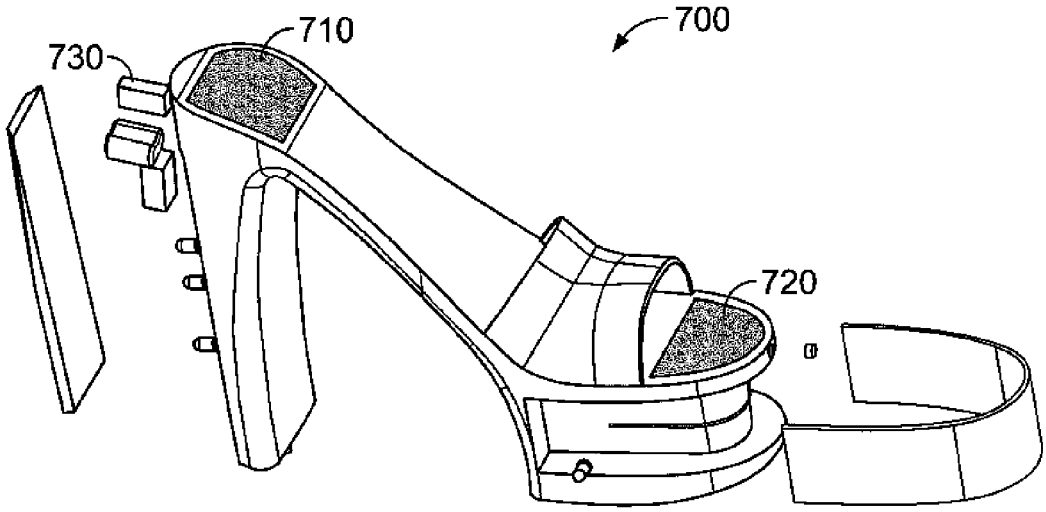
FIG. 7 illustrates an interactive illuminated shoe according to an alternative embodiment of the present invention.
Figure 7B:
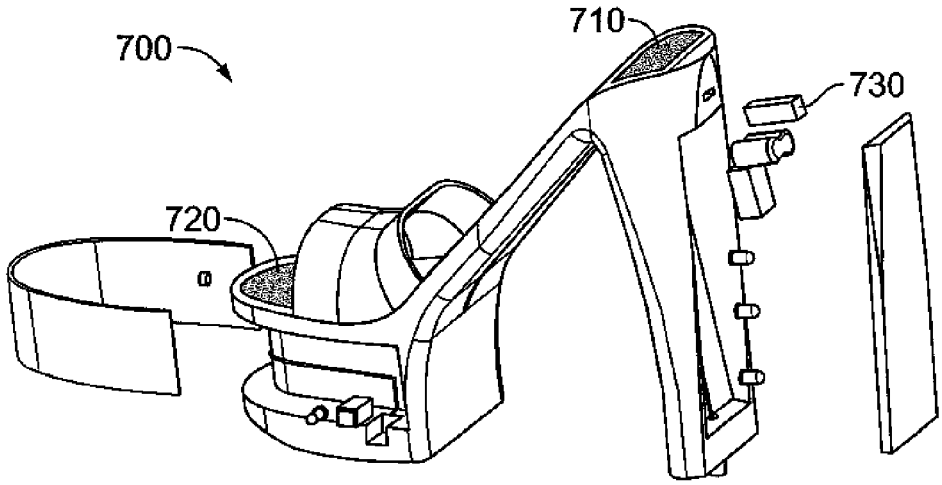

FIG. 7 illustrates an interactive illuminated shoe 700 according to an alternative embodiment of the present invention. The interactive illuminated shoe 700 includes the components of the illuminated shoe 200 discussed above with respect to FIG. 2, and, further includes a heel sensor plate 710, a sole sensor plate 720, and a sensor control unit 730. The heel sensor plate 710 is recessed into the top of the heel 110 of the interactive illuminated shoe 700 as illustrated in FIG. 7. The sole sensor plate 720 is similarly recessed into the top of the sole of the interactive illuminated shoe 700, as shown. The sensor control unit 730 may be incorporated into the control processor 240 but preferably is a separate unit also mounted in the heel 110. The sensor control unit 730 is attached to the heel sensor plate 710 and sole sensor plate 720 and processes data collected from the heel sensor plate 710 and sole sensor plate 720. The sensor control unit 730 is also preferably connected to the control processor 240 and can transmit to the control processor 240.

The heel sensor plate 710 and sole sensor plate 720 may be used to detect the physical characteristics of a wearer such as the wearer's temperature, moisture, blood pressure, or blood oxygen level, for example. In one embodiment, the heel sensor plate 710 and sole sensor plate 720 are used to detect a wearer's pulse (Plethysmography). A wearer's pulse may be detected using a heel sensor plate 710 and sole sensor plate 720 that are opto-pulse transducers which are widely commercially available. In operation, the heel sensor plate 710 and sole sensor plate 720 would continuously collect information about the wearer's pulse and send it to the sensor control unit 730. The sensor control unit 730 would continually process and monitor information about the wearer's pulse. The sensor control unit 730 would then continually send the pulse information to the control processor 240. Based on the information received from the sensor control unit 730, the control processor 240 would alter the visual characteristics of the sole LEDs 260 and the heel LEDs 250. For example, if a wearer's pulse were rapid, in the range of 120 to 150 beats per minute, the control processor 240 could illuminate red LEDs. If the wearer's pulse dropped to 100–120 beats per minute, the control processor 240 could illuminate yellow LEDs. If the wearer's pulse dropped to 80–100 beats per minute, the control processor 240 could illuminate green LEDs. As illustrated in this example, the visual characteristics, in this case color, of the sole LEDs 260 and the heel LEDs 250 would be determined based on the wearer's physical state. In another embodiment, temperature can be sensed by using commercially available heel sensor plates 710 and sole sensor plates 720 such as a type K (chrome-alumel), J, or other bimetallic thermocouples, Pt resistance sensors, optical pyrometers, or other known thermo sensors.

From the above description it can be seen that the interactive illuminated shoe of the present invention is able to overcome the shortcomings of prior art devices by providing footwear that senses the individual physical characteristics of the user and provides an individualized visual experience. This embodiment provides a level of interaction between a wearer and the visual display of the footwear not seen in the prior art.

While the invention has been described with reference to a preferred embodiment and alternative embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to any particular embodiment disclosed, but that the invention will include all embodiments falling within the scope of the appended claims.

What is claimed is:

1. Footwear incorporating an illumination system, said footwear comprising:

a sole including light transmitting material;

a first illumination device within the sole, the first illumination device being configured to provide light of a first color;

a second illumination device within the sole, the second illumination device being configured to provide light of a second color;

a heel including light transmitting material;

a third illumination device within the heel, the third illumination device being configured to provide light of a third color;

a fourth illumination device within the heel, the fourth illumination device being configured to provide light of a fourth color; and a power source for providing power to said first, second, third, and fourth illumination devices, wherein, the first color may be the same as the third color, the second color may be the same as the fourth color, and an outer surface of the sole is configured to blend light provided by said first and second illumination devices to provide light of a fifth color that is visible outside of the sole, and an outer surface of the heel is configured to blend light provided by said third and fourth illumination devices to provide light of a sixth color that is visible outside of the heel.

2. The footwear of claim 1 wherein one of said first and second illumination devices is a light emitting diode ("LED").

3. The footwear of claim 2 wherein said power source is a battery.

4. The footwear of claim 3 wherein said sole further includes mirror material located behind said first and second illumination devices for reflecting said light provided by said first and second illumination devices through said sole.

5. The footwear of claim 4 wherein said heel further includes mirror material located behind said third and fourth illumination devices for reflecting said light provided by said third and fourth illumination devices through said heel.

6. The footwear of claim 3 further including an effect device in said sole.

7. Footwear incorporating an audio/visual system, said footwear comprising:

a sole including light transmitting material;

a first illumination device within the sole, the first illumination device being configured to provide light of a first color;

a second illumination device within the sole, the second illumination device being configured to provide light of a second color;

a speaker;

an audio/visual control processor configured to blend said light provided by said first and second illumination devices to provide light of a third color that is visible outside of the sole, and configured to generate an audio signal displayed by said speaker; and a power source for providing power to said first and second illumination devices and said audio/visual control processor.

8. The footwear of claim 7 further comprising a pressure switch located in said sole for activating said audio signal when pressure is exerted on said pressure switch by a wearer of said footwear.

9. The footwear of claim 8 wherein said audio/visual control processor is comprised of a microprocessor and programmable read-memory ("PROM").

10. Footwear incorporating an interactive illumination system, said footwear comprising:

a sole including light transmitting material;

a first illumination device within the sole, the first illumination device being configured to provide light of a first color;

a second illumination device within the sole, the second illumination device being configured to provide light of a second color;

at least one sensor located in said sole for sensing information about a physical state of a wearer;

a sensor control unit for processing said information about the physical state of said wearer;

a control processor configured to blend said light provided by said first and second illumination devices to provide light of a third color that is visible outside of the sole in response to the physical state of said wearer;

a power source for providing power to said first and second illumination devices, said sensor control unit and said control processor;

a heel including light transmitting material;

a third illumination device within the heel, the third illumination device being configured to provide light of a fourth color;

a fourth illumination device within the heel, the fourth illumination device being configured to provide light of a fifth color; and at least one sensor located in said heel for sensing information about the physical state of a wearer, wherein said control processor is configured to blend light provided by said third and fourth illumination devices to provide light of a sixth color that is visible outside of the heel.

11. The footwear of claim 10 wherein said sensor is a pulse monitor.

12. The footwear of claim 10 wherein said sensor is a temperature monitor.

* * * * *